US009723970B1

(12) United States Patent
Carr et al.

(10) Patent No.: US 9,723,970 B1
(45) Date of Patent: Aug. 8, 2017

(54) DISHWASHER LOWER RACK STOP

(71) Applicants: BSH Home Appliances Corporation, Irvine, CA (US); BSH Hausgeräte GmbH, Munich (DE)

(72) Inventors: Casey Carr, New Bern, NC (US); David Hite, New Bern, NC (US); Napat Wanweerakul, Trent Woods, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/235,166

(22) Filed: Aug. 12, 2016

(51) Int. Cl.
*A47B 77/08* (2006.01)
*A47L 15/50* (2006.01)

(52) U.S. Cl.
CPC ..... *A47L 15/507* (2013.01)

(58) Field of Classification Search
CPC ..... A47L 15/50; A47L 15/504; A47L 15/506; A47L 15/507
See application file for complete search history.

(56) References Cited

U.S. PATENT DOCUMENTS 2,745,707 A * 5/1956 Sebens ..... A47L 15/507 134/165
3,194,610 A * 7/1965 Stewart ..... A47L 15/507 384/19
3,228,739 A * 1/1966 Hans ..... A47L 15/507 312/308
3,347,613 A * 10/1967 Krzewina ..... A47L 15/507 134/165
4,449,765 A * 5/1984 Lampman ..... A47L 15/507 16/267
6,571,965 B1 6/2003 Beck et al.
8,192,557 B2 * 6/2012 Ryu ..... A47L 15/504 134/147
2004/0103932 A1 * 6/2004 Kim ..... A47L 15/504 134/137
2005/0039782 A1 * 2/2005 Kim ..... A47L 15/504 134/58 D
2008/0011337 A1 * 1/2008 Ryu ..... A47L 15/504 134/147
2009/0096338 A1 * 4/2009 Jahrling ..... A47L 15/507 312/334.5
2009/0151758 A1 6/2009 Kristensson et al.
(Continued)

FOREIGN PATENT DOCUMENTS

DE 102010062780 A1 6/2012
KR 20070113637 A 11/2007
WO 2012089515 A1 7/2012

*Primary Examiner* — Hanh V Tran
(74) *Attorney, Agent, or Firm* — Michael E. Tschupp; Andre Pallapies

(57) ABSTRACT

A dishwasher includes a treatment chamber configured to clean dishes; a rack in the treatment chamber configured to hold dishes, the rack including an upper horizontal bar, a lower horizontal bar and a vertical bar; and a stop removably attached to the rack. The stop includes a first latch that is latched to the upper horizontal bar, a second latch that is latched to the lower horizontal bar, a third latch that is latched to the vertical bar, and a stopper portion that extends below a lowest wire in the rack and is configured to abut a portion of the dishwasher to limit travel of the rack out of the dishwasher.

25 Claims, 6 Drawing Sheets

(56) References Cited

U.S. PATENT DOCUMENTS

| | | | | |
|---|---|---|---|---|
| 2011/0114138 | A1* | 5/2011 | Bastuji | A47L 15/507 134/135 |
| 2011/0193457 | A1* | 8/2011 | Bastuji | A47L 15/502 312/311 |
| 2011/0286785 | A1* | 11/2011 | Brouwer | H02G 3/0443 403/188 |
| 2012/0062085 | A1* | 3/2012 | Bastuji | A47L 15/502 312/228.1 |
| 2013/0009530 | A1* | 1/2013 | Merz | A47L 15/507 312/228 |
| 2013/0093303 | A1* | 4/2013 | Carr | A47L 15/507 312/228.1 |
| 2013/0152983 | A1* | 6/2013 | Cox | A47L 15/507 134/164 |
| 2014/0137906 | A1* | 5/2014 | Shin | A47L 15/504 134/135 |
| 2014/0217868 | A1* | 8/2014 | Bhajak | A47L 15/50 312/228.1 |

* cited by examiner

DISHWASHER LOWER RACK STOP

FIELD OF TECHNOLOGY

The present technology relates to dishwashers, in particular dishwashers that have stops removably and/or adjustably attached to a dish rack.

BACKGROUND

Lower racks in a dishwasher are often installed in a manner that allows them to transition, by rolling or sliding, from inside a washing compartment onto a door that is horizontal when open. This type of arrangement may include a stop mechanism to prevent the rack from rolling out too far onto, or past, the door. The stop mechanism may be a feature of the door that causes a portion of the rack, such as a wheel, to be impeded from moving beyond a certain distance onto the door. In a similar manner, the rack itself could include a feature such as a downward protruding wire that engages part of the door and/or washing compartment to impede further movement of the rack.

BRIEF SUMMARY

Known stops for a dish rack suffer from problems. For example, if the stop is integral with the door or the rack, the stop may not be adjustable. Similarly, if the stop is integral, it may not be removable. Both of these problems could cause difficulties making parts interchangeable. An integrally formed stop may be problematic if a user does not want the stop. A stop that becomes damaged may be difficult to repair.

An aspect of the present technology solves one or more problems of the prior art.

Another aspect of the present technology includes a dishwasher comprising: a treatment chamber configured to clean dishes; a rack in the treatment chamber configured to hold dishes, the rack comprising an upper horizontal bar, a lower horizontal bar and a vertical bar; and a stop removably attached to the rack, the stop comprising a first latch that is latched to the upper horizontal bar, a second latch that is latched to the lower horizontal bar, a third latch that is latched to the vertical bar, and a stopper portion that extends below a lowest wire in the rack and is configured to abut a portion of the dishwasher to limit travel of the rack out of the dishwasher.

In examples, (a) the dishwasher further comprises wheels on the rack and a horizontal surface within the treatment chamber on which the wheels are configured to roll, wherein the stopper extends below the horizontal surface; (b) when viewed from a side of the rack, the upper horizontal bar, the lower horizontal bar and the vertical bar overlap each other in an I-shaped profile where the stop is removably attached to the rack; (c) the second latch is shaped to allow the stop to rotate about the lower horizontal bar; (d) the second latch has an inverted U-shaped profile when viewed parallel to an axis of the lower horizontal bar and the lower horizontal bar is within the inverted U-shaped profile; (e) the inverted U-shaped profile limits downward movement of the stop relative to the rack; (f) the inverted U-shaped profile allows upward movement of the stop relative to the rack; (g) the first latch includes a snap mechanism configured to releaseably attach to the upper horizontal bar; (h) the snap mechanism includes a substantially C-shaped profile where a clearance between the C-shaped profile and the upper horizontal bar allows vertical movement of the upper horizontal bar within the C-shaped profile; (i) the snap mechanism includes a substantially C-shaped profile that prevents vertical movement of the upper horizontal bar within the C-shaped profile; (j) the third latch includes a snap mechanism configured to releaseably attach to the vertical bar; (k) the stop comprises a vertical channel around the vertical bar and the third latch is at the top of the vertical channel; (l) the vertical channel bisects the first latch; (m) the vertical channel bisects the second latch; (n) the stopper portion includes an abutment surface configured to abut the portion of the dishwasher and the abutment surface is rearward of a rear-most portion of the first latch, the second latch and the third latch; (o) the upper horizontal bar and the lower horizontal bar are parallel but are not vertically aligned; and/or (p) the lower horizontal bar is closer to a center of the rack than the upper horizontal bar.

Another aspect of the present technology includes a stopper mechanism for use with a rack in a dishwasher, the stopper mechanism comprising: a first horizontal groove with a first opening facing towards a first side of the stopper mechanism, where the first opening is narrower than a remainder of the first horizontal groove that is inward from the first opening; a second horizontal groove with a second opening facing towards a bottom side of the stopper mechanism and closer to the bottom side than the first horizontal groove; a vertical groove with a third opening facing towards the first side of the stopper mechanism, where the third opening is narrower than a remainder of the vertical groove that is inward from the third opening; and an extension that extends beyond the second horizontal groove toward the bottom side of the stopper mechanism.

In examples, (a) the stopper mechanism has a horizontal portion and a vertical portion that together result in an overall shape that is substantially an inverted L-shape; (b) the first horizontal groove, the second horizontal groove and the vertical groove are within the horizontal portion of the L-shape and the extension is the vertical portion of the L-shape, (c) the first horizontal groove has a C-shaped profile and the second horizontal groove has an inverted U-shaped profile; (d) the second horizontal groove is substantially the same width from the second opening through an entire depth of the second horizontal groove; (e) a deepest location of the second horizontal groove is farther away from the first side than a deepest location of the first horizontal groove; (f) the vertical groove bisects that first horizontal groove; and/or (g) the vertical groove bisects the second horizontal groove.

Other aspects, features, and advantages of this technology will become apparent from the following detailed description when taken in conjunction with the accompanying drawings, which are a part of this disclosure and which illustrate, by way of example, principles of this technology.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, etc. may be used. However, these terms are not intended to be limiting or indicative of a specific order, but instead are used to distinguish similarly described features from one another, unless expressly noted otherwise. Terms such as substantially and about are intended to allow for variances to account for manufacturing tolerances, measurement tolerances, or variations from ideal values that would be accepted by those skilled in the art.

Throughout this disclosure, the terms top, bottom, front, back, left and right may be used. These terms are only intended to provide relational orientation with respect to one another. For example, any two opposed sides can be a right side and a left side and by changing to an opposed viewpoint, right versus left will be changed. Thus, top, bottom, front, back, left and right should not be considered limiting and are used only to distinguish their relationship to one another.

Figure 1:
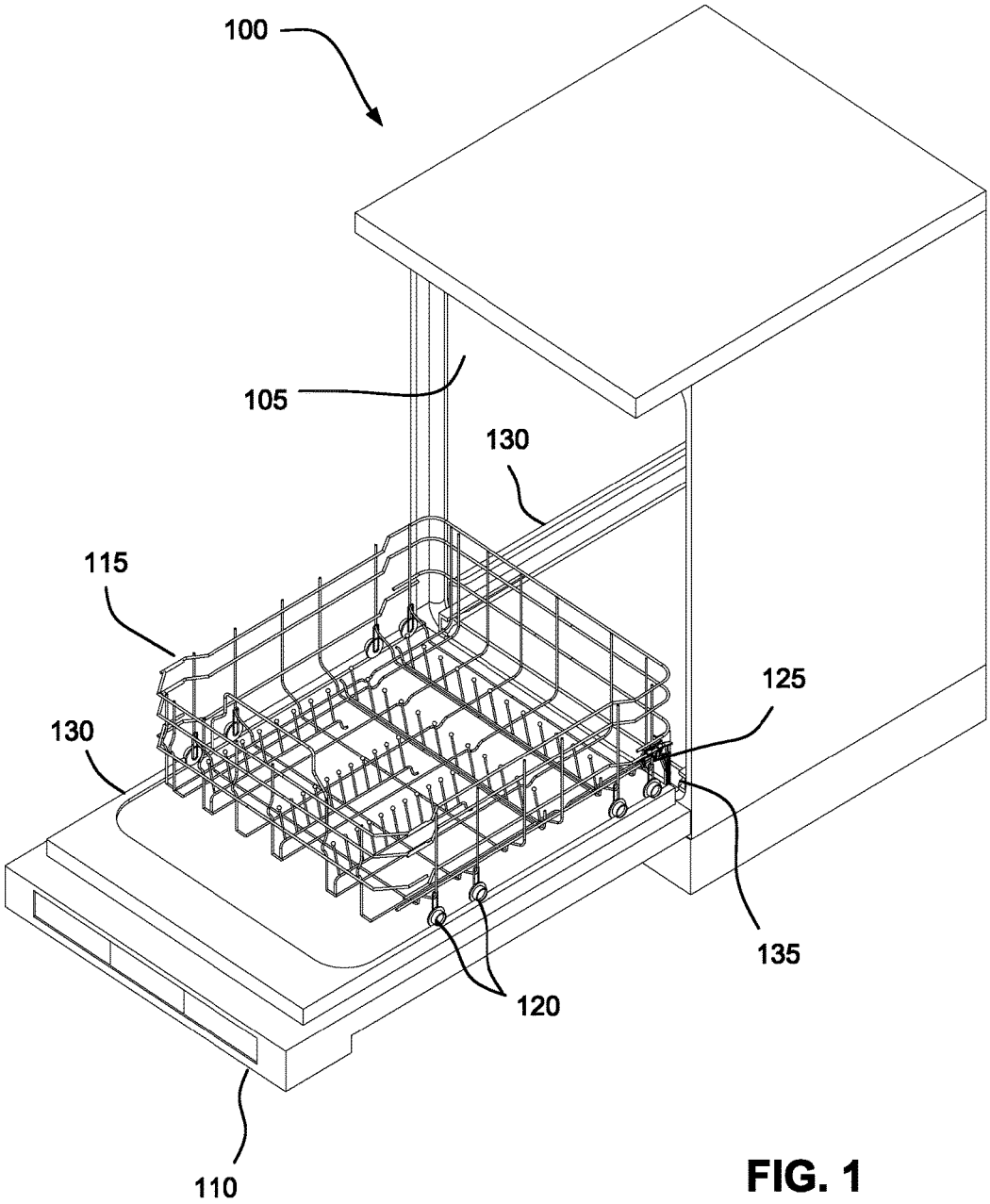
FIG. 1 is a perspective view of a dishwasher.

FIG. 1 illustrates a dishwasher 100 with a door 105 illustrated in an open condition so that a treatment chamber 110 (configured to clean dishes) and a rack 115 (configured to hold dishes) are visible. The rack 115 includes a plurality of wheels 120 and a stop 125. The wheels 120 are configured to roll on a horizontal surface 130, which is partly within the treatment chamber 110 and partly on the door 105. The stop may be configured to abut a surface 135 such as a bottom edge of the door 105 or a on a portion of the treatment chamber 110. These surfaces are exemplary and should not be considered limiting because the stop 125 may be configured to abut any convenient surface.

For clarity, the remaining figures include only the rack 115 and/or stop 125.

Figure 2:
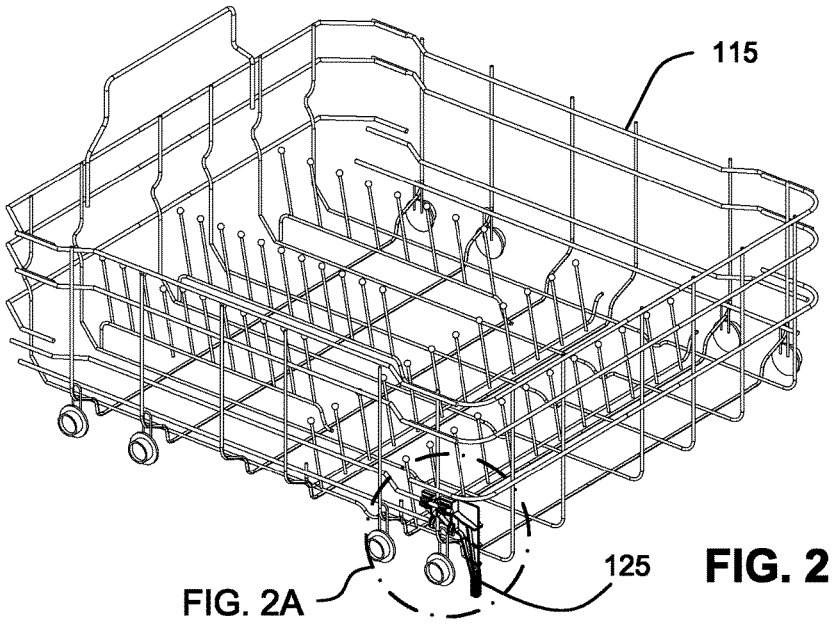
FIG. 2 is a perspective view of a dishwasher rack.
Figure 2A:
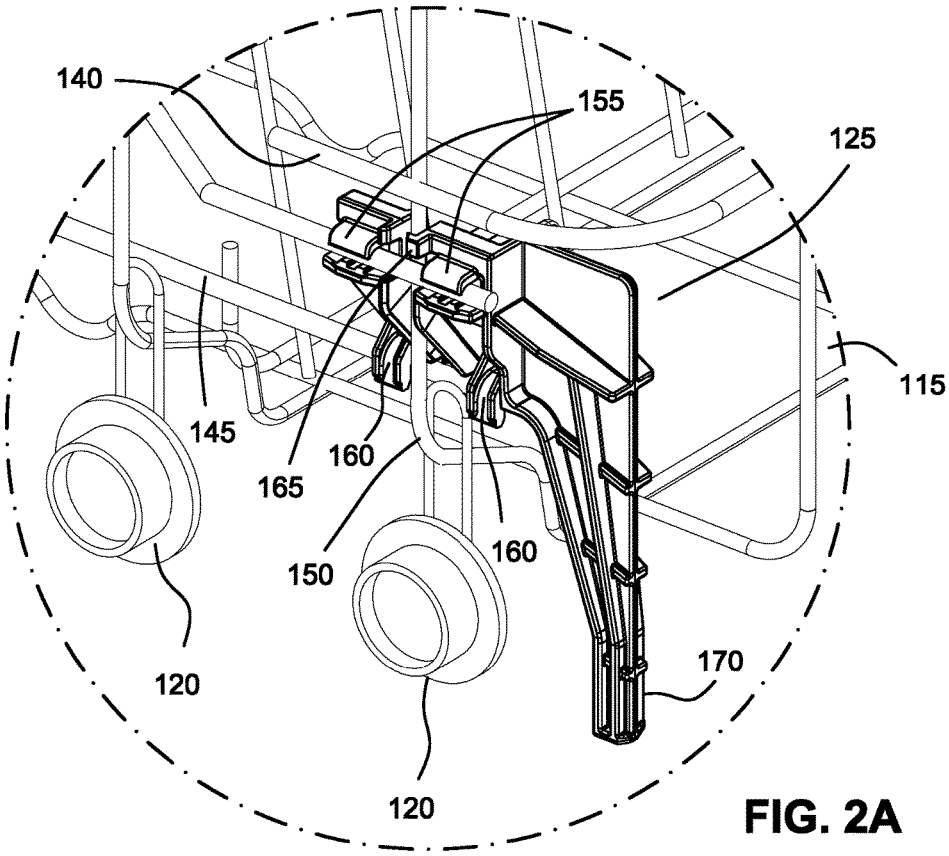
FIG. 2A is an enlarged portion of FIG. 2.

FIG. 2 is a perspective view from the right rear corner of the rack 115 where the stop 125 is attached to the rack 115. FIG. 2A is an enlarged portion of FIG. 2 to better illustrate how the rack 115 and stop 125 interface one another.

The rack 115 includes an upper horizontal bar 140 and a lower horizontal bar 145. Here, upper and lower are in reference to one another and not the most upper or lower because FIG. 2A, as well as other figures, clearly illustrates other horizontal bars above and below the upper horizontal bar 140 and lower horizontal bar 145. The rack 115 also includes a vertical bar 150. The stop 125 is attached to the rack 115 at the upper horizontal bar 140, lower horizontal bar 145 and vertical bar 150 by a first latch 155, a second latch 160 and a third latch 165, respectively. The latches are described in greater detail below. The stop 125 includes a stopper portion 170, which is a portion that abuts the surface 135.

Figure 3:
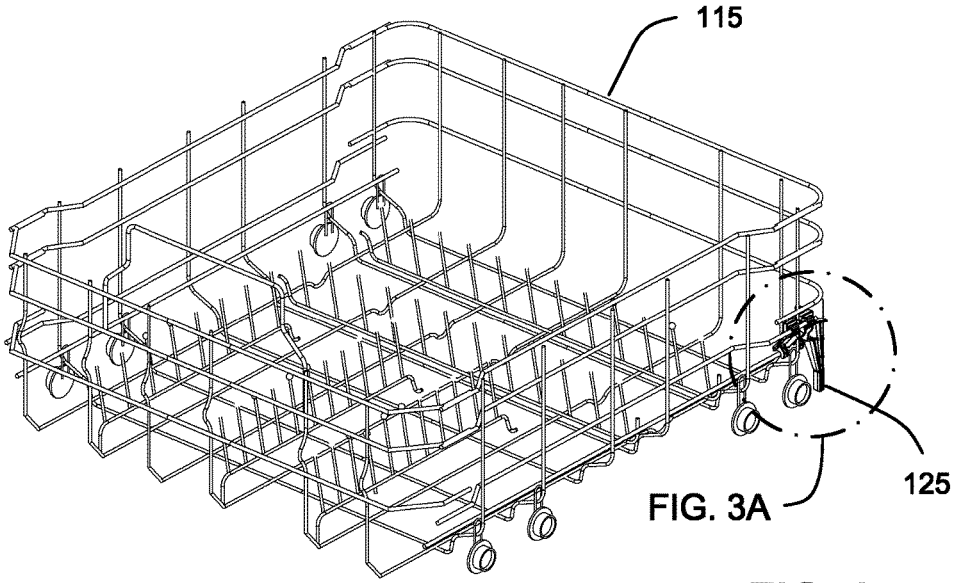
FIG. 3 is a perspective view of a dishwasher rack.
Figure 3A:
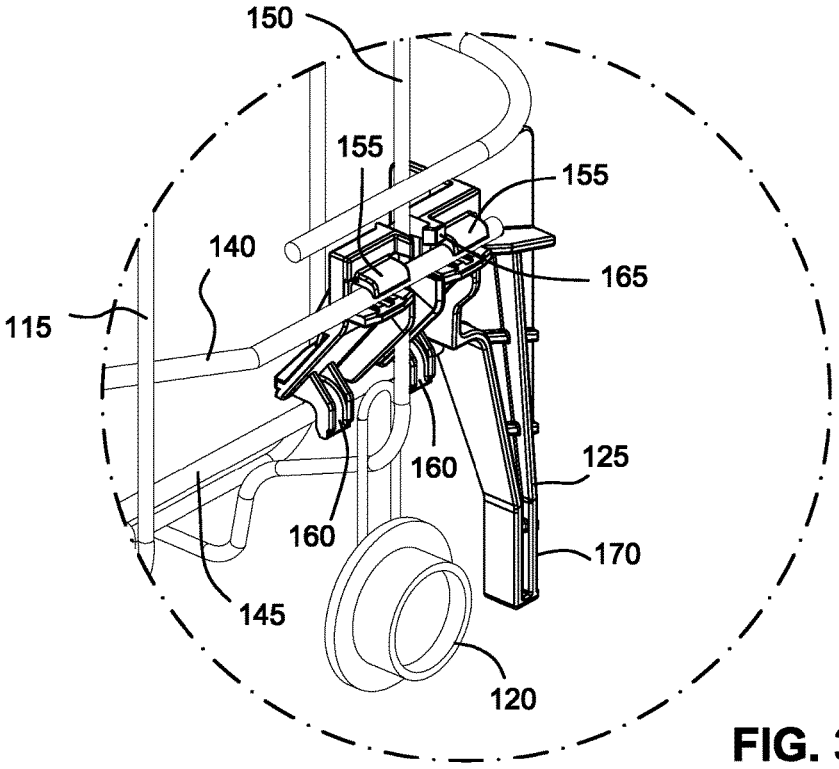
FIG. 3A is an enlarged portion of FIG. 3.

FIGS. 3 and 3A are similar to FIGS. 2 and 2A except that the perspective is from the right front corner of the rack 115, which makes additional details visible.

Figure 4:
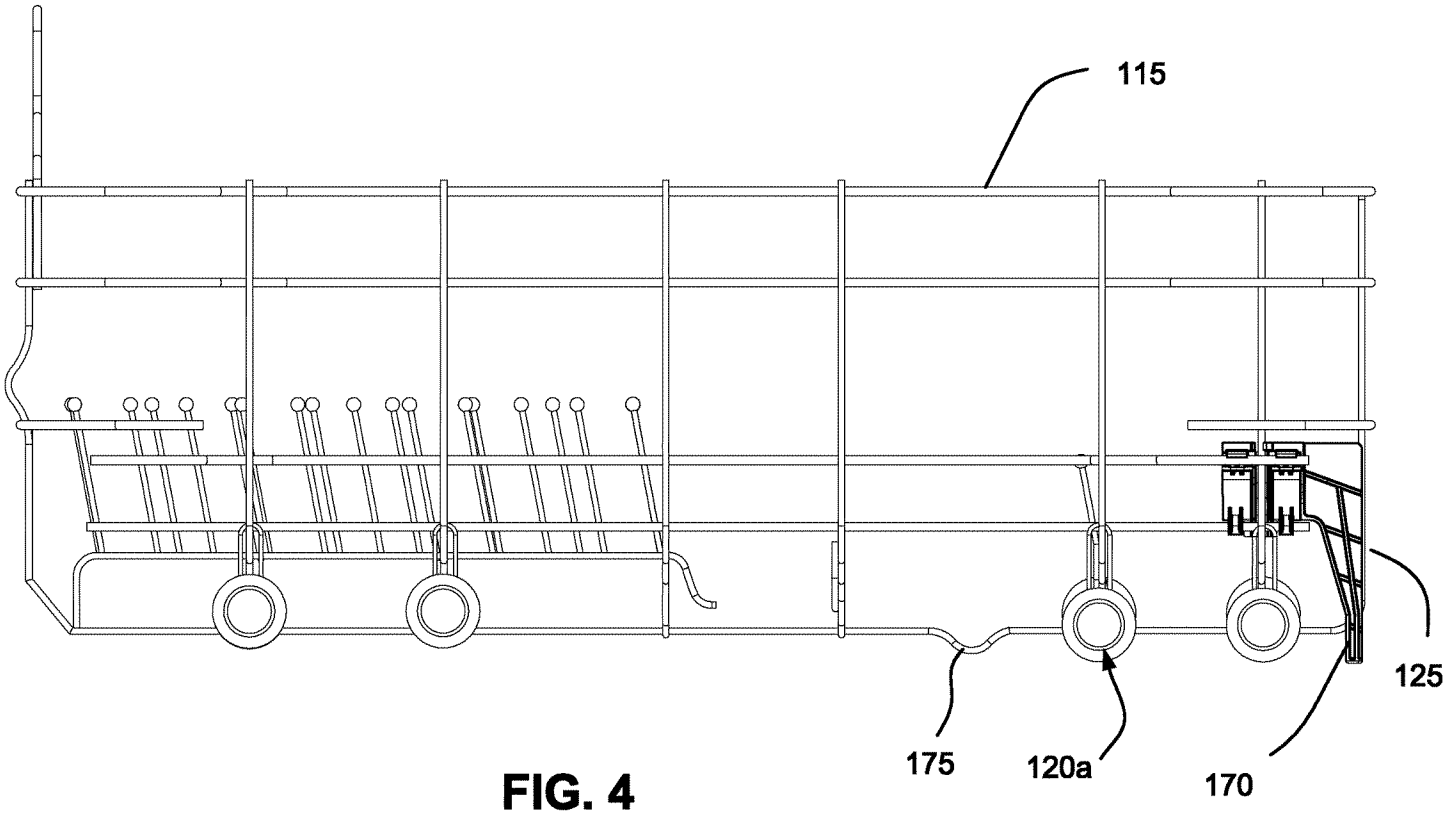
FIG. 4 is a side view of a dishwasher rack.

FIG. 4 illustrates the rack 115 from the right side. In this view, the relative positions of the stopper portion 170, the lowest wire 175 and a rolling surface 120*a* of the wheels 120 are apparent. The stopper portion 170 extends below both the lowest wire 175 and the rolling surface 120*a*. Although the amount that the stopper portion 170 extends below these features is relatively small in this figure, the amount of extension can be greater or less depending on the relative location of the surface 135 and/or the wires where the stop 125 is attached to the rack 115.

FIG. 4 also illustrates the relationship of the upper horizontal bar 140, the lower horizontal bar 145 and vertical bar 150. When viewed at least from this direction, the three bars overlap to form an I-shaped profile.

FIGS. 5A-5E include various views of the stop 125.

Figure 5A:
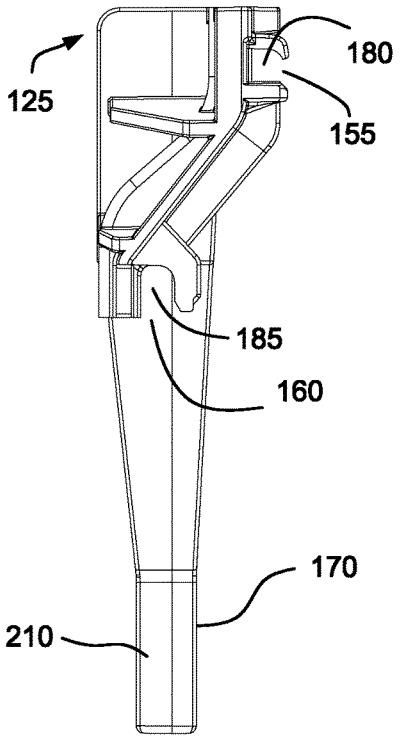
FIG. 5A is a front view of a removable stop for the dishwasher rack.

FIG. 5A illustrates the stop 125 from a front side, which highlights the profiles of the first latch 155 and the second latch 160. The profile of the first latch 155 is substantially C-shaped and bounds a first channel 180 normal to this view. With this profile, a snap-fit can be achieved when sized correctly with respect to the upper horizontal bar 140. So long as the upper horizontal bar 140 has a larger diameter than the opening of the C-shaped profile, a snap fit can be achieved. Depending on the interior height of the C-shaped profile, the first latch 155 may allow some vertical movement (if there is clearance) or no vertical movement (if there is no clearance).

The second latch 160 has an inverted U-shaped profile and bounds a second channel 185 normal to this view. This profile allows the lower horizontal bar 145 to be inserted therein with little or no resistance until reaching the maximum depth of the second channel 185. The inverted U-shaped profile will allow rotational movement of the stop 125 relative to the lower horizontal bar 145 and when the stop is oriented vertically, left-right movement will be prevented. When the lower horizontal bar 145 is inserted into the inverted U-shaped profile, the stop 125 can be rotated so that the first latch 155 engages the upper horizontal bar 140. With both the first latch 155 and the second latch 160 engaged with their respective bars, the stop may be substantially or fully constrained from movement except along the length of those bars.

The first latch 155 is horizontally offset to the right of the second latch 160 in FIG. 5A. With this type of offset, rotating the stop 125 about the lower horizontal bar 145 by way of the second latch 160 results in the first latch 155 approaching the upper horizontal bar 140 in downward and rightward motion, which may assist in passing the upper horizontal bar into and through the opening of the first latch 155.

Figure 5B:
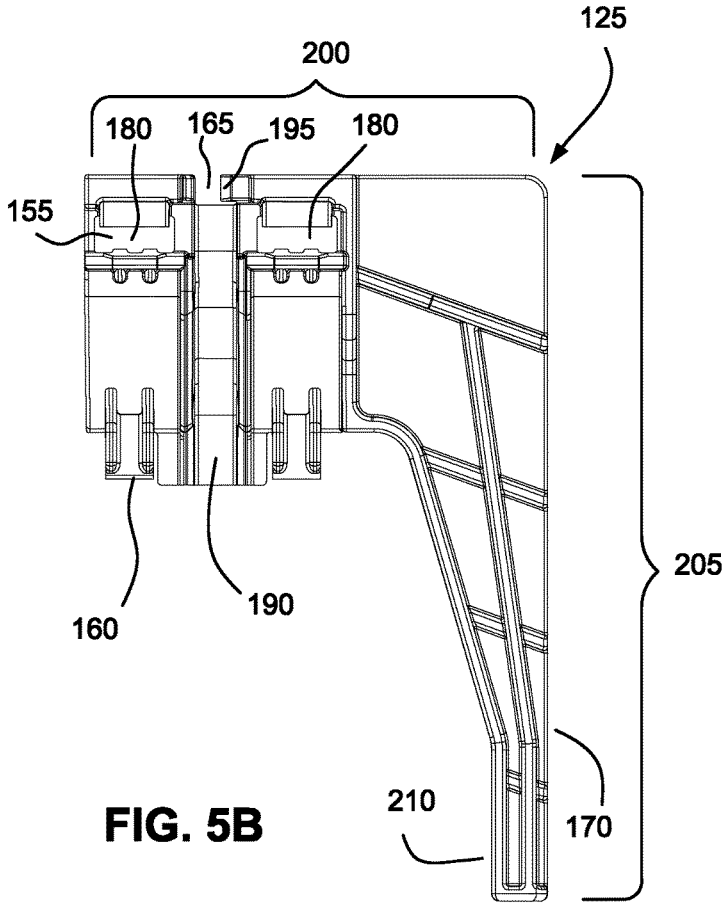
FIG. 5B is a right side view of a removable stop for the dishwasher rack.

FIG. 5B illustrates the third latch 165, includes a third channel 190 oriented vertically with a snap-fit 195 (see FIG. 5E) at the top of the third channel 190. With this configuration, the third latch 165 prevents motion that is not prevented by the first latch 155 and the second latch 160 and thus the stop 125 can be constrained with three degrees of translational and rotational freedom. Also, by including the snap-fit 195 at the top of the third channel 190, or at least above the first latch 155, the third latch 165 may not engage simultaneously with the first latch 155, which may reduce the force necessary to install the stop 125 to the rack 115.

As illustrated, the third channel 190 divides the first latch 155 and the second latch 160 substantially in half. However, the division need not be symmetrical and the third channel 190 need not divide the first latch 155 and/or the second latch 160 at all.

With each of the first latch 155, the second latch 160 and the third latch 165, depth of their respective grooves refers to a distance from their respective openings to their respective closed sides. Thus, based on the orientation illustrated in FIG. 5A, the depth of the first latch 155 and the third latch 165 (not visible in FIG. 5A) is the same direction (from right to left) whereas the depth of the second latch 160 is orthogonal to that of the first latch 155 and the third latch 165 (upwards).

As best viewed in FIG. 5B, the stop 125 includes a horizontal portion 200 and a vertical portion 205, which together are substantially an inverted L-shape. The stopper portion 170 is included toward one end of the vertical portion and the first latch 155, second latch 160 and third latch 165 are included in the horizontal portion 200. With this configuration, the stopper portion 170 can extend below the rack 115 to engage the surface 135. As illustrated, the front surface 210 of the stopper portion 170 will abut the surface 135 to limit travel of the rack 115.

As illustrated throughout the figures, the stop 125 includes numerous ribs, which may provide strength and/or rigidity. For example, the first latch 155 includes ribs on the lower half of the C-shaped profile, which may allow the upper half of the C-shaped profile to bend preferentially over the lower half. This may cooperate with the rotational installation procedure described above.

Figure 5C:
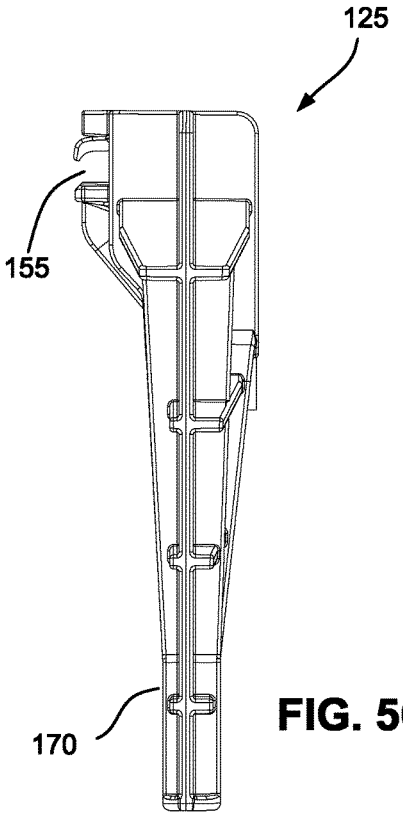
FIG. 5C is a rear view of a removable stop for the dishwasher rack.
Figure 5D:
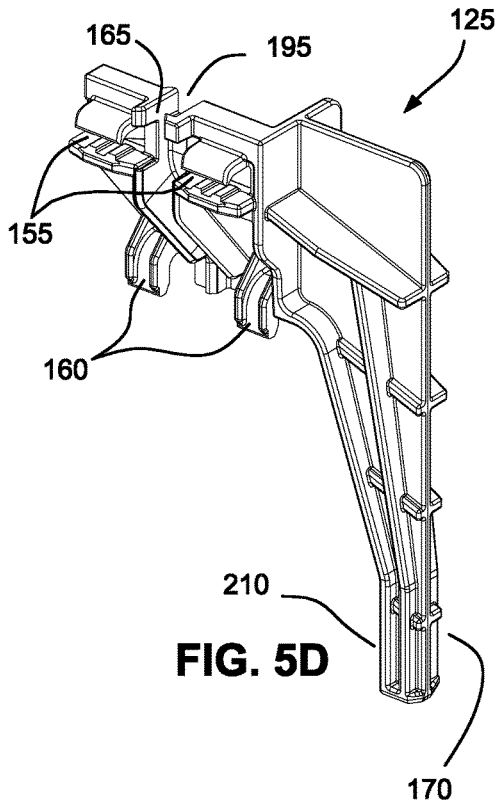
FIG. 5D is a first perspective view of a removable stop for the dishwasher rack.
Figure 5E:
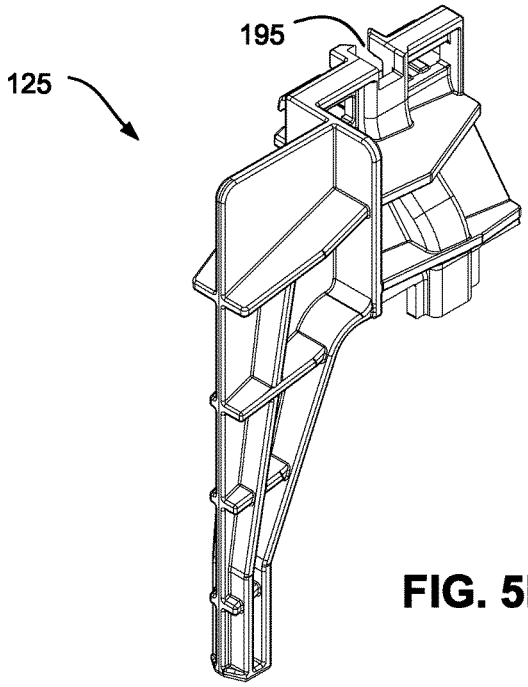
FIG. 5E is a second perspective view of a removable stop for the dishwasher rack.

FIGS. 5C-5E provide additional details of stop 125 to provide further understanding of the features described above.

The technology described above is advantageous in that the stop 125 may be used on various different dish racks, which can reduce inventory costs by allowing a common stop to be used with multiple dishwashers and/or racks. Also, if the rack is provided with appropriate bars for attachment, the position of the stop can be changed so that the same rack can be stopped at different amounts of travel out of the treatment chamber 110. Since the stop 125 is removably attached, it can be replaced if broken or retrofitted to dishwashers without the stop 125. The configuration is also beneficial in that no special tools are necessary for attachment. Also, the disclosed shape and location of attachment is beneficial in that a rotary spray arm under the rack will not likely be interfered with by the stop.

While the present technology has been described in connection with several practical examples, it is to be understood that the technology is not to be limited to the disclosed examples, but on the contrary, is intended to cover various modifications and equivalent arrangements included within the spirit and scope of the technology.

The invention claimed is:

1. A dishwasher comprising:

a treatment chamber configured to clean dishes;

a rack in the treatment chamber configured to hold dishes, the rack comprising an upper horizontal bar, a lower horizontal bar and a vertical bar; and a stop removably attached to the rack, the stop comprising a first latch that is latched to the upper horizontal bar, a second latch that is latched to the lower horizontal bar, a third latch that is latched vertically above the first latch to the vertical bar, and a stopper portion that extends below a lowest wire in the rack and is configured to abut a portion of the dishwasher to limit travel of the rack out of the dishwasher.

2. The dishwasher according to claim 1, further comprising wheels on the rack and a horizontal surface within the treatment chamber on which the wheels are configured to roll, wherein the stopper portion extends below the horizontal surface.

3. The dishwasher according to claim 1, wherein, when viewed from a side of the rack, the upper horizontal bar, the lower horizontal bar and the vertical bar overlap each other in an I-shaped profile where the stop is removably attached to the rack.

4. The dishwasher according to claim 1, wherein the second latch is shaped to allow the stop to rotate about the lower horizontal bar.

5. The dishwasher according to claim 4, wherein the second latch has an inverted U-shaped profile when viewed parallel to an axis of the lower horizontal bar and the lower horizontal bar is within the inverted U-shaped profile.

6. The dishwasher according to claim 5, wherein the inverted U-shaped profile limits downward movement of the stop relative to the rack.

7. The dishwasher according to claim 6, wherein the inverted U-shaped profile allows upward movement of the stop relative to the rack.

8. The dishwasher according to claim 1, wherein the first latch includes a snap mechanism configured to releaseably attach to the upper horizontal bar.

9. The dishwasher according to claim 8, wherein the snap mechanism includes a substantially C-shaped profile where a clearance between the C-shaped profile and the upper horizontal bar allows vertical movement of the upper horizontal bar within the C-shaped profile.

10. The dishwasher according to claim 8, wherein the snap mechanism includes a substantially C-shaped profile that prevents vertical movement of the upper horizontal bar within the C-shaped profile.

11. The dishwasher according to claim 1, wherein the third latch includes a snap mechanism configured to releaseably attach to the vertical bar.

12. The dishwasher according to claim 1, wherein the stop comprises a vertical channel around the vertical bar and the third latch is at the top of the vertical channel.

13. The dishwasher according to claim 12, wherein the vertical channel bisects the first latch.

14. The dishwasher according to claim 12, wherein the vertical channel bisects the second latch.

15. The dishwasher according to claim 1, wherein the stopper portion includes an abutment surface configured to abut the portion of the dishwasher and the abutment surface is rearward of a rear-most portion of the first latch, the second latch and the third latch.

16. The dishwasher according to claim 1, wherein the upper horizontal bar and the lower horizontal bar are parallel but are not vertically aligned.

17. The dishwasher according to claim 16, wherein the lower horizontal bar is closer to a center of the rack than the upper horizontal bar.

18. A stopper mechanism for use with a rack in a dishwasher, the stopper mechanism comprising:

a first horizontal groove with a first opening facing towards a first side of the stopper mechanism, where the first opening is narrower than a remainder of the first horizontal groove that is inward from the first opening;

a second horizontal groove with a second opening facing towards a bottom side of the stopper mechanism and closer to the bottom side than the first horizontal groove;

a vertical groove with a third opening facing towards the first side of the stopper mechanism, where the third opening is narrower than a remainder of the vertical groove that is inward from the third opening, at least part of the third opening being positioned closer to a top side of the stopper mechanism than the first opening; and an extension that extends beyond the second horizontal groove toward the bottom side of the stopper mechanism.

19. The stopper mechanism of claim 18, wherein the stopper mechanism has a horizontal portion and a vertical portion that together result in an overall shape that is substantially an inverted L-shape.

20. The stopper mechanism of claim 19, wherein the first horizontal groove, the second horizontal groove and the vertical groove are within the horizontal portion of the L-shape and the extension is the vertical portion of the L-shape.

21. The stopper mechanism of claim 18, wherein the first horizontal groove has a C-shaped profile and the second horizontal groove has an inverted U-shaped profile.

22. The stopper mechanism of claim 18, wherein the second horizontal groove is substantially the same width from the second opening through an entire depth of the second horizontal groove.

23. The stopper mechanism of claim 18, wherein a deepest location of the second horizontal groove is farther away from the first side than a deepest location of the first horizontal groove.

24. The stopper mechanism of claim 18, wherein the vertical groove bisects that first horizontal groove.

25. The stopper mechanism of claim 24, wherein the vertical groove bisects the second horizontal groove.

* * * * *